US006673995B2

(12) United States Patent
Ogawa et al.

(10) Patent No.: US 6,673,995 B2
(45) Date of Patent: Jan. 6, 2004

(54) MUSICAL SIGNAL PROCESSING APPARATUS

(75) Inventors: Michiko Ogawa, Osaka (JP); Ryosuke Kobayashi, Takaraduka (JP); Tomomi Hirata, Neyagawa (JP); Toshihiko Date, Nara (JP)

(73) Assignee: Matsushita Electric Industrial Co., Ltd., Osaka-fu (JP)

( * ) Notice: Subject to any disclaimer, the term of this patent is extended or adjusted under 35 U.S.C. 154(b) by 81 days.

(21) Appl. No.: 09/985,619

(22) Filed: Nov. 5, 2001

(65) Prior Publication Data

US 2002/0053275 A1 May 9, 2002

(30) Foreign Application Priority Data

Nov. 6, 2000 (JP) ..... 2000-337089

(51) Int. Cl.[7] ..... G10H 5/00
(52) U.S. Cl. ..... 84/653; 84/656
(58) Field of Search ..... 84/609, 616, 615, 84/653, 649, 656

(56) References Cited

U.S. PATENT DOCUMENTS 5,792,971 A * 8/1998 Timis et al. ..... 84/609
5,895,876 A * 4/1999 Moriyama et al. ..... 84/609
6,034,315 A * 3/2000 Takenaka et al. ..... 84/615
6,545,209 B1 * 4/2003 Flannery et al. ..... 84/609
2002/0002899 A1 * 1/2002 Gjerdingen et al. ..... 84/667
2002/0087565 A1 * 7/2002 Hoekman et al. ..... 707/100

FOREIGN PATENT DOCUMENTS

JP 8-298418 11/1996

* cited by examiner

*Primary Examiner*—Jeffrey Donels
(74) *Attorney, Agent, or Firm*—Wenderoth, Lind & Ponack, L.L.P.

(57) ABSTRACT

The characteristic value detection section detects a characteristic value concerning input musical data. The detected characteristic value is converted by a genre information determination section to genre information representing a genre of the contents of the input musical data. Based on the genre information, a parameter determination section determines an acoustic processing parameter which is used for adjusting the tone of the output from a acoustic processing section. In accordance with the acoustic processing parameter as determined, the acoustic processing section applies predetermined acoustic processing to the input musical data. The musical data having been subjected to the predetermined acoustic processing is reproduced by a reproduction section. Thus, the musical signal processing device makes it possible to obtain a tone which is adapted to the contents of the input musical data.

6 Claims, 20 Drawing Sheets

FIG. 4

| CHARACTERISTIC VALUE | | | |
|---|---|---|---|
| BPM | FB | AR | GENRE NAME |
| 120>=BPM>=90 | 1.0>=FB>=0.9 | AR>=80 | POPS |
| 140>=BPM>=100 | 0.9>=FB>=0.8 | AR>=90 | ROCK |
| BPM<=70 | 0.6>=FB | AR>=70 | SLOW BALLAD |
| 100>=BPM>=70 | 0.8>=FB>=0.7 | 100>=AR>=80 | EURO BEAT |
| ⋮ | ⋮ | ⋮ | ⋮ |

FIG. 5

| GENRE NAME | CHARACTERISTIC VALUE (TEMPO) | PATTERN NUMBER |
|---|---|---|
| ROCK | 100-110 | 0 |
| | 111-115 | 1 |
| | 116-120 | 2 |
| | 121-125 | 3 |
| | 126-130 | 4 |
| | 131-135 | 5 |
| | 136-140 | 6 |
| POPS | 90-93 | 0 |
| | 94-97 | 1 |
| | 98-101 | 2 |
| | 102-105 | 3 |
| | 106-110 | 4 |
| | 111-115 | 5 |
| | 116-120 | 6 |
| ⋮ | ⋮ | ⋮ |

F I G. 6

| | | ACOUSTIC PROCESSING PARAMETER (asb, bsb, csb, dsb) | | | |
|---|---|---|---|---|---|
| GENRE NAME | PATTERN NUMBER | asb | bsb | csb | dsb |
| POPS | 0 | 3 | 1 | 11, 12 | 34, 35 |
| | 1 | 4 | 2 | 12, 13 | 35, 36 |
| | 2 | 5 | 3 | 11, 13 | 34, 36 |
| | 3 | 6 | **** | 11, 14 | 34, 37 |
| | 4 | **** | **** | 11, 15 | **** |
| | 5 | **** | **** | 10, 16 | **** |
| | 6 | **** | **** | 9, 17 | **** |
| ROCK | 0 | 2 | 1 | 11, 12 | 34, 35 |
| | 1 | 3 | 2 | 12, 13 | 34, 35 |
| | 2 | 4 | 3 | 11, 13 | 34, 36 |
| | 3 | 5 | **** | 11, 14 | 34, 37 |
| | 4 | **** | **** | 11, 15 | **** |
| | 5 | **** | **** | 10, 16 | **** |
| | 6 | **** | **** | 9, 17 | **** |
| SLOW BALLAD | 0 | 2 | 1 | 11, 12 | 34, 35 |
| | 1 | 3 | 2 | 12, 13 | 35, 36 |
| | 2 | 4 | 3 | 11, 13 | 34, 36 |
| | 3 | 5 | **** | 11, 14 | 34, 37 |
| | 4 | **** | **** | 11, 15 | **** |
| | 5 | **** | **** | 10, 16 | **** |
| | 6 | **** | **** | 10, 17 | **** |
| EURO BEAT | 0 | 3 | 1 | 10, 11 | 34, 35 |
| | 1 | 4 | 2 | 11, 12 | 35, 36 |
| | 2 | 5 | 3 | 12, 13 | 34, 36 |
| | 3 | 6 | **** | 12, 14 | 34, 37 |
| | 4 | **** | **** | 11, 15 | **** |
| | 5 | **** | **** | 10, 16 | **** |
| | 6 | **** | **** | 10, 17 | **** |
| ⋮ | ⋮ | ⋮ | ⋮ | ⋮ | ⋮ |

FIG. 8

| CHARACTERISTIC VALUE | | | FEELING EXPRESSION VALUE | | | |
|---|---|---|---|---|---|---|
| BPM | FB | AR | A | B | C | D |
| 120>=BPM>=90 | 1.0>=FB>=0.9 | AR>=80 | 1 | 2 | 3 | 3 |
| 140>=BPM>=100 | 0.9>=FB>=0.8 | AR>=90 | 2 | 1 | 3 | 3 |
| BPM<=70 | 0.6>=FB | AR>=70 | 1 | 1 | 4 | 3 |
| 100>=BPM>=70 | 0.8>=FB>=0.7 | 100>=AR>=80 | 3 | 2 | 4 | 2 |
| ⋮ | ⋮ | ⋮ | ⋮ | ⋮ | ⋮ | ⋮ |

FIG. 9

| FEELING EXPRESSION VALUE (A) | ACOUSTIC PROCESSING PARAMETER(asb) |
|---|---|
| 0 | 3 |
| 1 | 4 |
| 2 | 5 |
| 3 | 6 |
| 4 | **** |
| 5 | **** |
| 6 | **** |
| FEELING EXPRESSION VALUE (B) | ACOUSTIC PROCESSING PARAMETER(bsb) |
| 0 | 1 |
| 1 | 2 |
| 2 | 3 |
| 3 | **** |
| 4 | **** |
| 5 | **** |
| 6 | **** |
| FEELING EXPRESSION VALUE (C) | ACOUSTIC PROCESSING PARAMETER(csb) |
| 0 | 11, 12 |
| 1 | 12, 13 |
| 2 | 11, 13 |
| 3 | 11, 14 |
| 4 | 11, 15 |
| 5 | 10, 16 |
| 6 | 9, 17 |
| FEELING EXPRESSION VALUE (D) | ACOUSTIC PROCESSING PARAMETER(dsb) |
| 0 | 34, 35 |
| 1 | 35, 36 |
| 2 | 34, 36 |
| 3 | 34, 37 |
| 4 | **** |
| 5 | **** |
| 6 | **** |

FIG. 11

| | | ACOUSTIC PROCESSING PARAMETER (asb, bsb, csb, dsb) | | | |
|---|---|---|---|---|---|
| GENRE NAME | FEELING EXPRESSION VALUE | asb | bsb | csb | dsb |
| POPS | 0 | 3 | 1 | 11, 12 | 34, 35 |
| | 1 | 4 | 2 | 12, 13 | 35, 36 |
| | 2 | 5 | 3 | 11, 13 | 34, 36 |
| | 3 | 6 | **** | 11, 14 | 34, 37 |
| | 4 | **** | **** | 11, 15 | **** |
| | 5 | **** | **** | 10, 16 | **** |
| | 6 | **** | **** | 9, 17 | **** |
| ROCK | 0 | 2 | 1 | 11, 12 | 34, 35 |
| | 1 | 3 | 2 | 12, 13 | 34, 35 |
| | 2 | 4 | 3 | 11, 13 | 34, 36 |
| | 3 | 5 | **** | 11, 14 | 34, 37 |
| | 4 | **** | **** | 11, 15 | **** |
| | 5 | **** | **** | 10, 16 | **** |
| | 6 | **** | **** | 9, 17 | **** |
| SLOW BALLAD | 0 | 2 | 1 | 11, 12 | 34, 35 |
| | 1 | 3 | 2 | 12, 13 | 35, 36 |
| | 2 | 4 | 3 | 11, 13 | 34, 36 |
| | 3 | 5 | **** | 11, 14 | 34, 37 |
| | 4 | **** | **** | 11, 15 | **** |
| | 5 | **** | **** | 10, 16 | **** |
| | 6 | **** | **** | 10, 17 | **** |
| EURO BEAT | 0 | 3 | 1 | 10, 11 | 34, 35 |
| | 1 | 4 | 2 | 11, 12 | 35, 36 |
| | 2 | 5 | 3 | 12, 13 | 34, 36 |
| | 3 | 6 | **** | 12, 14 | 34, 37 |
| | 4 | **** | **** | 11, 15 | **** |
| | 5 | **** | **** | 10, 16 | **** |
| | 6 | **** | **** | 10, 17 | **** |
| ⋮ | ⋮ | ⋮ | ⋮ | ⋮ | ⋮ |

FIG. 13

| GENRE NAME | FEELING EXPRESSION VALUE (A) | Fs (kHz) | PROCESSED RANGE (kHz) |
|---|---|---|---|
| ROCK | 0 | 32 | 0.04 |
| | | 44.1 | 0.03 |
| | | 48 | 0.03 |
| | 1 | 32 | 0.05 |
| | | 44.1 | 0.04 |
| | | 48 | 0.045 |
| | 2 | 32 | 0.06 |
| | | 44.1 | 0.055 |
| | | 48 | 0.06 |
| | ⋮ | ⋮ | ⋮ |
| POPS | 0 | 32 | 0.04 |
| | | 44.1 | 0.04 |
| | | 48 | 0.03 |
| ⋮ | ⋮ | ⋮ | ⋮ |

| GENRE NAME | FEELING EXPRESSION VALUE (B) | Fs (kHz) | PROCESSED RANGE (kHz) |
|---|---|---|---|
| ROCK | ⋮ | ⋮ | ⋮ |
| | 1 | 44.1 | 0.08 |
| ⋮ | ⋮ | ⋮ | ⋮ |

| GENRE NAME | FEELING EXPRESSION VALUE (C) | Fs (kHz) | PROCESSED RANGE (kHz) |
|---|---|---|---|
| ROCK | ⋮ | ⋮ | ⋮ |
| | 2 | 44.1 | 1.0, 1.2 |
| ⋮ | ⋮ | ⋮ | ⋮ |

| GENRE NAME | FEELING EXPRESSION VALUE (D) | Fs (kHz) | PROCESSED RANGE (kHz) |
|---|---|---|---|
| ROCK | ⋮ | ⋮ | ⋮ |
| | 3 | 44.1 | 11, 13 |
| ⋮ | ⋮ | ⋮ | ⋮ |

FIG. 14

| SFB | Fs=48(k | Fs=44.1(kHz) | Fs=32(k | Fs=24(k | Fs=22.05(kHz) |
|---|---|---|---|---|---|
| 0 | 0 | 0 | 0 | 0 | 0 |
| 1 | 93.8 | 86.1 | 62.5 | 46.9 | 43.1 |
| 2 | 187.5 | 172.3 | 125 | 93.8 | 86.1 |
| 3 | 281.3 | 258.4 | 187.5 | 140.6 | 129.2 |
| 4 | 375 | 344.5 | 250 | 187.5 | 172.3 |
| 5 | 468.8 | 430.7 | 312.5 | 234.4 | 215.3 |
| 6 | 562.5 | 516.8 | 375 | 281.3 | 258.4 |
| 7 | 656.3 | 602.9 | 437.5 | 328.1 | 301.5 |
| ⋮ | ⋮ | ⋮ | ⋮ | ⋮ | ⋮ |

FIG. 15

| PROCESSED RANGE (Hz) | Fs (kHz) | ACOUSTIC PROCESSING PARAMETER (esb) |
|---|---|---|
| 0 | 44.1 | 0 |
| | 48 | 0 |
| 30 | 44.1 | 0 |
| | 48 | 0 |
| 60 | 44.1 | 0 |
| | 48 | 0 |
| 90 | 44.1 | 1 |
| | 48 | 1 |
| 120 | 44.1 | 1 |
| | 48 | 1 |
| 150 | 44.1 | 1 |
| | 48 | 1 |
| 180 | 44.1 | 2 |
| | 48 | 2 |
| 210 | 44.1 | 2 |
| | 48 | 2 |
| 240 | 44.1 | 3 |
| | 48 | 2 |
| 270 | 44.1 | 3 |
| | 48 | 3 |
| 300 | 44.1 | 3 |
| | 48 | 3 |
| 330 | 44.1 | 4 |
| | 48 | 3 |
| 360 | 44.1 | 4 |
| | 48 | 4 |
| 390 | 44.1 | 4 |
| | 48 | 4 |
| ⋮ | ⋮ | ⋮ |

MUSICAL SIGNAL PROCESSING APPARATUS

BACKGROUND OF THE INVENTION

1. Field of the Invention

The present invention relates to a musical signal processing device, and more particularly to a musical signal processing device for outputting audio data which is adapted to the tonal characteristics of input audio data.

2. Description of the Background Art

Various musical signal processing devices for outputting processed audio data by applying acoustic signal processing to input audio data to are conventionally available. Examples of such musical signal processing devices include: tone control devices such as graphic equalizers, compressors, and tone controls; acoustic effect devices such as reverb machines, delay machines, and flanger machines; and audio data editing devices such as cross-fading devices and noise reduction devices. Such devices enjoy popularity across a wide range of fields, from music production studios for business use to sound reproduction devices for consumer use. Moreover, the changes in the manner s of music distribution in recent years have led to the increasing prevalence of devices such as audio data compression encoders and electronic watermark data embedders. As such, musical signal processing devices are being utilized by producers at music producing entities, individual musicians, or general users who pursue music for their hobbies, etc., for the purpose of tone adjustment, musical creation, and preprocessing for (satisfying the range constraints or the like of) subsequent processes, among other applications.

FIG. 20 is a block diagram illustrating the general structure of a commonly-used conventional musical signal processing device. As shown in FIG. 20, the conventional musical signal processing device includes an input section 91 and an acoustic processing section 92. In accordance with a user instruction, the input section 91 outputs parameters to the acoustic processing section 92 which define conditions for the processing to be performed by the acoustic processing section 92. In accordance with the parameters received from the input section 91, the acoustic processing section 92 applies a predetermined processing algorithm to input data so as to output processed data. Thus, the musical signal processing device is capable of adjusting the tone of the output audio data based on the parameters as manipulated by the user via the input section 91.

As disclosed in Japanese Patent Laid-Open Publication No. 8-298418, a musical signal processing device has been proposed in which commonly-used terms or expressions can be utilized as a tone evaluation language for adjusting the tone of the device. This device allows a user to input his/her feeling about the tone of an output sound from the device by using terms or expressions which are commonly used as the tone evaluation language for sound reproduction devices, whereby settings of an FIR filter of a graphic equalizer can be established. As a result, general users who may lack in knowledge and/or experience in handling acoustic processing can easily perform a tone adjustment.

In conventional musical signal processing devices, when a user determines that the tone of an output sound (hereinafter referred to as "output tone") is inappropriate, the user takes the trouble of again setting the parameters of tone adjustment in order to obtain an appropriate Output tone.

However, the musical data to be processed by the aforementioned musical signal processing devices may have varying contents, so that the processes which are appropriate for the musical data may differ depending on its content. For example, musical data of certain contents may require an acoustic processing for enhancing the low-frequency components, whereas musical data of other contents may require an acoustic processing for enhancing the high-frequency components.

Therefore, in accordance with conventional musical signal processing devices, a set of parameters which have once been optimized by a user may not be optimum for a different kind of input data. In other words, conventional musical signal processing devices cannot perform acoustic processing in accordance with the content of input musical data.

SUMMARY OF THE INVENTION

Therefore, an object of the present invention is to provide a musical signal processing device capable of providing a tone which is adapted to the content of input musical data.

The present invention has the following features to attain the object above.

A first aspect of the present invention is directed to a musical signal processing device for applying predetermined acoustic processing to input musical data, comprising: an analysis section for analyzing acoustic characteristics of the input musical data to produce an analysis result; a parameter determination section for determining an acoustic processing parameter in accordance with the analysis result by the analysis section, the acoustic processing parameter being used for adjusting a tone of an output of the predetermined acoustic processing; and an acoustic processing section for applying the predetermined acoustic processing to the input musical data in accordance with the acoustic processing parameter determined by the parameter determination section.

Thus, according to the first aspect, it is possible to set an acoustic processing parameter in accordance with an analysis result representing the acoustic characteristics of input musical data. By employing such an acoustic processing parameter for changing the tone of the output musical data, it is possible to change the output tone in accordance with the analysis result, so that an output tone which is adapted to the contents of the input musical data can be obtained.

According to a second aspect based on the first aspect, the analysis section comprises: a characteristic value detection section for detecting a characteristic value representing characteristics of contents of the input musical data, the characteristic value being used as the analysis result; and an intermediate data generation section for generating intermediate data, wherein the intermediate data represents the characteristic value detected by the characteristic value detection section in terms of an index which is different from the characteristic value and which is in a form readily understandable to humans, and wherein the parameter determination section determines the acoustic processing parameter based on the intermediate data which is generated by the intermediate data generation section.

Thus, according to the second aspect, a characteristic value representing an analysis result of the input musical data is converted to intermediate data expressed by using an index which is in a form readily understandable to humans, and then an acoustic processing parameter is determined based on the index. Since the determination of the acoustic processing parameter from the characteristic value is generally made by using conversion rules, the conversion of the characteristic value to an index in a form readily understandable to humans facilitates the preparation of the conversion rules as compared to the case where the characteristic value is directly converted to an acoustic processing parameter.

According to a third aspect based on the second aspect, the intermediate data is genre information representing a genre in which the input musical data is classified.

Thus, according to the third aspect, genre information is employed as intermediate data in the process of obtaining an acoustic processing parameter from a characteristic value. It is presumable that the conditions for appropriate acoustic processing will be similar for any pieces of music (as represented by the input musical data) that are of the same genre or similar genres. Therefore, an appropriate acoustic processing parameter can be easily set by determining the acoustic processing conditions depending on the genre of a given piece of music. The use of genre information as intermediate data facilitates the preparation of conversion rules for obtaining an acoustic processing parameter from a characteristic value.

According to a fourth aspect based on the second aspect, the intermediate data is a feeling expression value representing a psychological measure of a user concerning a tone of music.

Thus, according to the fourth aspect, a feeling expression value is employed as intermediate data in the process of obtaining an acoustic processing parameter from a characteristic value. It is presumable that the conditions for appropriate acoustic processing will be similar for any pieces of music (as represented by the input musical data) that are associated with the same feeling expression value or similar feeling expression values. Therefore, an appropriate acoustic processing parameter can be easily set by determining the output tone depending on the feeling expression value. Thus, the use of a feeling expression value as intermediate data facilitates the preparation of conversion rules for obtaining an acoustic processing parameter from a characteristic value.

According to a fifth aspect based on the third aspect, the musical signal processing device further comprises a user input section for receiving a feeling expression value which is inputted by a user, the feeling expression value representing a psychological measure of the user concerning a tone of music, wherein the parameter determination section determines the acoustic processing parameter based on the feeling expression value which is inputted to the user input section and the genre information which is generated by the intermediate data generation section.

Thus, according to the fifth aspect, an acoustic processing parameter is determined based on the analysis result of input musical data as well as a user input. By thus allowing a user input to be reflected in the determination process of the acoustic processing parameter, it is possible to reproduce a tone which more accurately approximates the desire of the user.

According to a sixth aspect based oil the fifth aspect, the feeling expression value received by the user input section is of a different type depending on the genre represented by the genre information generated by the intermediate data generation section.

Thus, according to the sixth aspect, the type of feeling expression value which is inputted by a user varies depending on the genre of a piece of music represented by the input musical data. It is presumable that a different genre will call for a different set of expressions for expressing the tone of a given piece of music and that the meaning of each expression may differ depending on the genre. Therefore, a user can input a different type of feeling expression value(s) for each genre into which the contents of input musical data may be categorized. Thus, the user can achieve tone adjustment by employing appropriate expressions in accordance with each genre, thereby being able to arrive at the desired tone with more ease.

According to a seventh aspect based on the first aspect, the acoustic processing section is an audio compression encoder for applying data compression to the input musical data; and the musical signal processing device further comprises: a decoder for decoding an output from the audio compression encoder to generate decoded data; and a comparison section for comparing acoustic characteristics of the input musical data and acoustic characteristics of the decoded data from the decoder to detect a frequency range in which the acoustic processing parameter is to be modified, wherein the parameter determination section modifies the acoustic processing parameter with respect to the frequency range detected by the comparison section.

Thus, according to the seventh aspect, the acoustic characteristics of input data and the acoustic characteristics of output data which results after audio compression are compared in order to detect a frequency range in which the output tone is to be conceited. Based on the detected frequency range, an acoustic processing parameter may be set again. By thus modifying the acoustic processing parameter, any determination in the sound quality which might otherwise occur when the acoustic processing is an audio compression performed by an audio compression encoder can be substantially prevented.

An eighth aspect of the present invention is directed to a musical signal processing method for applying predetermined acoustic processing to input musical data, comprising: an analysis step of analyzing acoustic characteristics of the input musical data to produce an analysis result; a parameter determination step of determining an acoustic processing parameter in accordance with the analysis result by the analysis step, the acoustic processing parameter being used for adjusting a tone of an output of the predetermined acoustic processing; and an acoustic processing step of applying the predetermined acoustic processing to the input musical data in accordance with the acoustic processing parameter determined by the parameter determination step.

Thus, according to the eighth aspect, it is possible to set an acoustic processing parameter in accordance with an analysis result representing the acoustic characteristics of input musical data. By employing such an acoustic processing parameter for changing the tone of the output musical data, it is possible to change the output tone in accordance with the analysis result, so that an output tone which is adapted to the contents of the input musical data can be obtained.

According to a ninth aspect based on the eighth aspect, the analysis step comprises: a characteristic value detection step of detecting a characteristic value representing characteristics of contents of the input musical data, the characteristic value being used as the analysis result, and an intermediate data generation step of generating intermediate data, wherein the intermediate data represents the characteristic value detected by the characteristic value detection step in terms of an index which is different from the characteristic value and which is in a form readily understandable to humans, wherein the parameter determination step determines the acoustic processing parameter based on the intermediate data which is generated by the intermediate data generation step.

Thus, according to the ninth aspect, a characteristic value representing an analysis result of the input musical data is converted to and index which is in a form readily understandable to humans, and then an acoustic processing parameter is determined based on the index. Since the determination of the acoustic processing parameter from the characteristic value is generally made by using conversion rules, the conversion of the characteristic value to an index in a form readily understandable to humans facilitates the preparation of the conversion rules as compared to the case where the characteristic value is directly converted to an acoustic processing parameter.

According to a tenth aspect based on the ninth aspect, the intermediate data is genre information representing a genre in which the input musical data is classified.

Thus, according to the tenth aspect, genre information is employed as intermediate data in the process of obtaining an acoustic processing parameter from a characteristic value. It is presumable that the conditions for appropriate acoustic processing will be similar for any pieces of music (as represented by the input musical data) that are of the same genre or similar genres. Therefore, an appropriate acoustic processing parameter can be easily set by determining the acoustic processing conditions depending on the genre of a given piece of music. The use of genre information as intermediate data facilitates the preparation of conversion rules for obtaining an acoustic processing parameter from a characteristic value.

According to an eleventh aspect based on the ninth aspect, the intermediate data is a feeling expression value representing a psychological measure of a user concerning a tone of music.

Thus, according to the eleventh aspect, a feeling expression value is employed as intermediate data in the process of obtaining an acoustic processing parameter from a characteristic value. It is presumable that the conditions for appropriate acoustic processing will be similar for any pieces of music (as represented by the input musical data) that are associated with the same feeling expression value or similar feeling expression values. Therefore, an appropriate acoustic processing parameter can be easily set by determining the output tone depending on the feeling expression value. Thus, the use of a feeling expression value as intermediate data facilitates the preparation of conversion rules for obtaining an acoustic processing parameter from a characteristic value.

According to a twelfth aspect based on the tenth aspect, the musical signal processing method further comprises a user input step of receiving a feeling expression value which is inputted by a user, the feeling expression value representing a psychological measure of the user concerning a tone of music, wherein the parameter determination step determines the acoustic processing parameter based on the feeling expression value which is inputted by the user input step and the genre information which is generated by the intermediate data generation step.

Thus, according to the twelfth aspect, an acoustic processing parameter is determined based on the analysis result of input musical data as well as a user input. By thus allowing a user input to be reflected in the determination process of the acoustic processing parameter, it is possible to reproduce a tone which more accurately approximates the desire of the user.

According to a thirteenth aspect based on the twelfth aspect, the feeling expression value received in the user input step is of a different type depending on the genre represented by the genre information generated by the intermediate data generation step.

Thus, according to the thirteenth aspect, the type of feeling expression value which is inputted by a user varies depending on the genre of a piece of music represented by the input musical data. It is presumable that a different genre will call for a different set of expressions for expressing the tone of a given piece of music and that the meaning of each expression may differ depending on the genre. Therefore, a user can input a different type of feeling expression value(s) for each genre into which the contents of input musical data may be categorized. Thus, the user can achieve tone adjustment by employing appropriate expressions in accordance with each genre, thereby being able to arrive at the desired tone with more ease.

According to a fourteenth aspect based on the eighth aspect, the acoustic processing step comprises applying data compression to the input musical data to produce compressed data; and the musical signal processing method further comprises: a decoding step of decoding the compressed data to generate decoded data; and a comparison step of comparing acoustic characteristics of the input musical data and acoustic characteristics of the decoded data to detect a frequency range in which the acoustic processing parameter is to be modified, wherein the parameter determination step modifies the acoustic processing parameter with respect to the frequency range detected by the comparison step.

Thus, according to the fourteenth aspect, the acoustic characteristics of input data and the acoustic characteristics of output data which results after audio compression are compared in order to detect a frequency range in which the output tone is to be connected. Based on the detected frequency range, an acoustic processing parameter may be set again. By thus modifying the acoustic processing parameters any deterioration in the sound quality which might otherwise occur when the acoustic processing comprises audio compression can be substantially prevented.

These and other objects, features, aspects and advantages of the present invention will become more apparent from the following detailed description of the present invention when taken in conjunction with the accompanying drawings.

BRIEF DESCRIPTION OF THE DRAWINGS

FIG. 4 shows an example of a characteristic value/genre name conversion table which is previously provided in a genre information determination section 312 shown in FIG. 2;

FIG. 5 shows an example of a characteristic value/pattern number conversion table which is previously provided in the genre information determination section 312 shown in FIG. 2;

FIG. 6 shows an example of a genre information/parameter conversion table which is previously provided in a parameter determination section 313 shown in FIG. 2;

FIG. 8 shows an example of a characteristic value/feeling expression value conversion table which is previously provided in a feeling expression value determination section 321 shown in FIG. 7;

FIG. 9 shows an example of a feeling expression value/parameter conversion table which is previously provided in a parameter determination section 323 shown in FIG. 7;

FIG. 11 shows an example of a genre name-feeling expression value/parameter conversion table which is previously provided in a parameter determination section 333 shown in FIG. 10;

FIG. 13 shows an example of a feeling expression value/processed range conversion table which is previously provided in a processed range determination section 343 shown in FIG. 12;

FIG. 14 is a table describing the correspondence between scale factor band values and input data frequencies, which varies depending on the sampling frequency of the input data;

FIG. 15 shows an example of a processed range/parameter conversion table which is previously provided in a parameter determination section 344 shown in FIG. 12;

DESCRIPTION OF THE PREFERRED EMBODIMENTS

Figure 1:
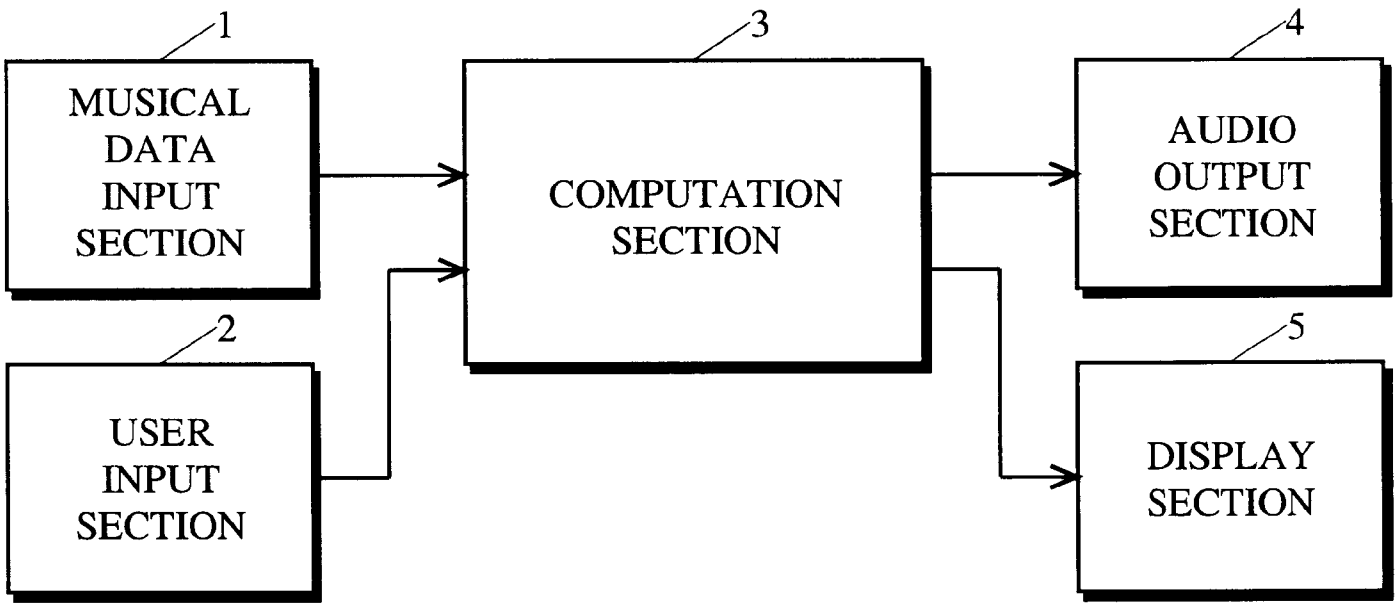
FIG. 1 is a block diagram illustrating the structure of a musical signal processing device according to a first embodiment of the present invention.

FIG. 1 is a block diagram illustrating the structure of a musical signal processing device according to the first embodiment of the present invention. As shown in FIG. 1, the musical signal processing device includes a musical data input section 1, a user input section 2, a computation section 3, an audio output section 4, and a display section 5.

Figure 2:
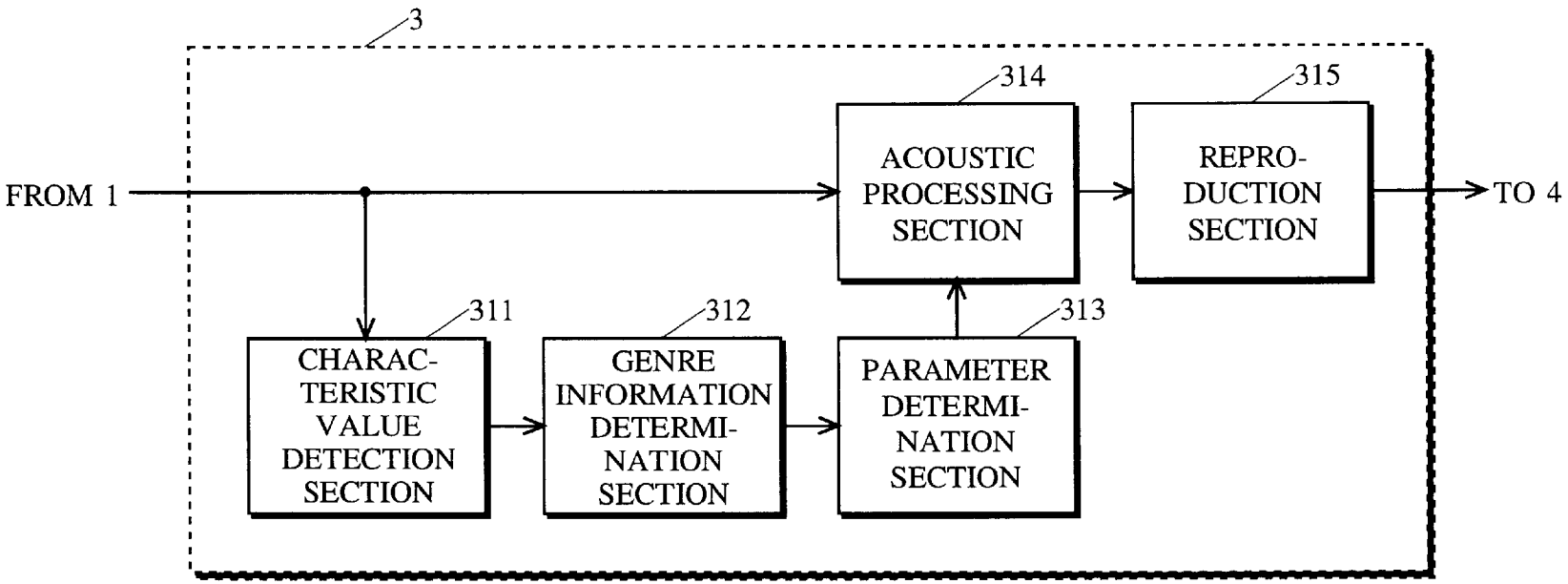
FIG. 2 is a block diagram illustrating the detailed structure of a computation section 3 shown in FIG. 1.

The musical data input section 1 inputs musical data, which is to be subjected to the acoustic processing performed within the musical signal processing device, to the computation section 3. The musical data input section 1 may prestore the musical data. If the musical signal processing device is capable of communicating with other devices over a network, the musical data may be obtained from another device(s) via network communication. The user input section 2 inputs data which is necessary for the processing of the musical data in accordance with a user instruction. The computation section 3, which comprises a CPU, a memory, and the like, performs predetermined acoustic processing for the input musical data which has been inputted from the musical data input section 1. In the present embodiment, it is assumed that the predetermined acoustic processing involves changing the format of the input data and applying a data compression to the resultant data. In other words, the computation section 3 functions as an audio compression encoder. The details of the computation section 3 are as shown in FIG. 2. The audio output section 4, which is composed of loudspeakers and the like, transducers the musical data which has been processed by the computation section 3 into output sounds. The display section 5, which may be implemented by using a display device or the like, displays the data which is used for the processing of the musical data.

FIG. 2 is a block diagram showing a detailed structure of the computation section 3 shown in FIG. 1. As shown in FIG. 2, the computation section 3 includes a characteristic value detection section 311, a genie information determination section 312, a parameter determination section 313, an acoustic processing section 314, and a reproduction section 315. Hereinafter, the respective elements will be specifically described, and the operation of the computation section 3 will be described.

The characteristic value detection section 311 analyzes the acoustic characteristics of the input musical data which has been inputted from the musical data input section 1. Specifically, the characteristic value detection section 311 detects characteristic values from the input musical data. As used herein, "characteristic values" are defined as values which represent the characteristics of the content of musical data. In the present embodiment, a tempo, a fundamental beat, and an attack rate are used as characteristic values. Hereinafter, the acoustic characteristics analysis performed by the characteristic value detection section 311 will be specifically described.

Figure 3:
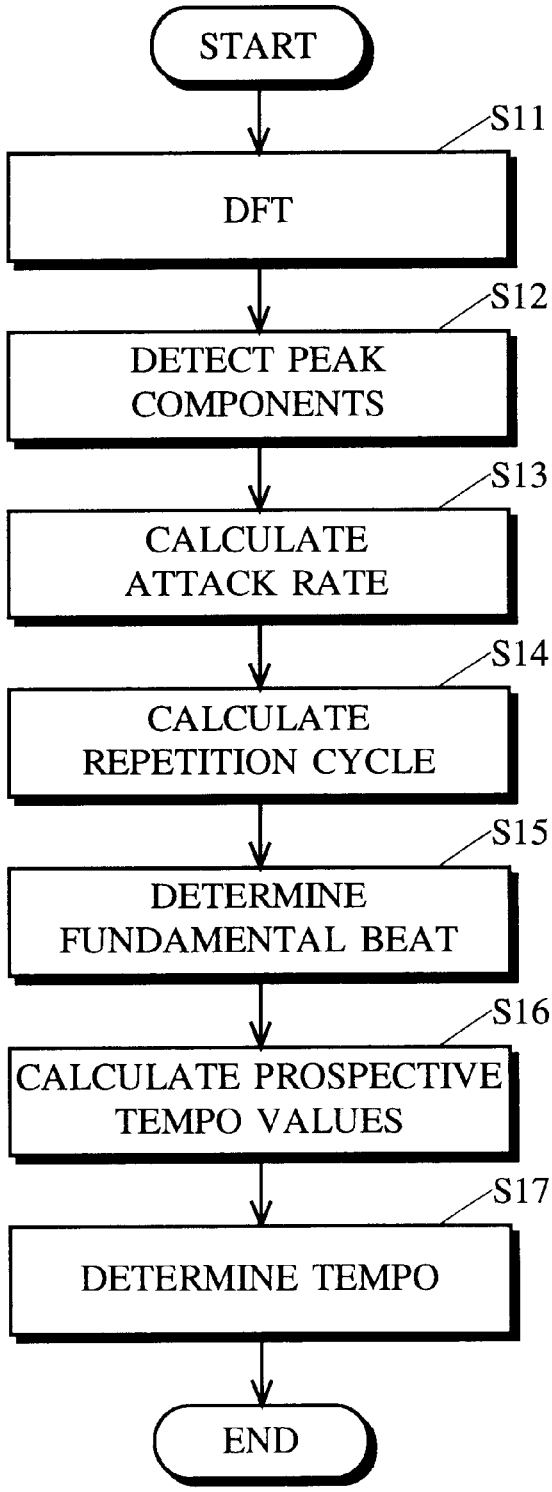
FIG. 3 is a flowchart illustrating a flow of acoustic characteristics analysis performed by a characteristic value detection section 311 shown in FIG. 2.

FIG. 3 is a flowchart illustrating a flow of the acoustic characteristics analysis performed by the characteristic value detection section 311 shown in FIG. 2. First, the characteristic value detection section 311 applies a discrete Fourier transform (DFT) to the input musical data (step S11). Next, based on a spectrum which is calculated through the DFT at step S11, the characteristic value detection section 311 detects peak components (step S12). As used herein, a "peak component" means any position of a spectrum calculated through tile DFT that has an energy component equal to or greater than a predetermined level. Next, based on the peak component(s) detected at step S12, the characteristic value detection section 311 calculates an attack rate (step S13). The attack rate is calculated by deriving an average number of peak components in unit time.

Following step S13, based on tile peak component(s) detected at step S12, the characteristic value detection section 311 calculates a repetition cycle of energy components in the input signal (step S14). Specifically, the characteristic value detection section 311 derives an autocorrelation of the input signal, and calculates peak values of correlation coefficients. As used herein, a "peak value" represents a delay time associated with any correlation coefficient whose magnitude is equal to or greater than a predetermined level. Furthermore, based on the peak values calculated at step S14, the characteristic value detection section 311 analyzes the beat structure of the input signal so as to determine a fundamental beat (step S15). Specifically, the characteristic value detection section 311 analyzes the beat structure of the input signal based on the rising and falling patterns of the peak values.

Following step S15, the characteristic value detection section 311 derives a repetition cycle of the peak values calculated at step S14, and calculates one or more prospective values for the tempo (step S16). Furthermore, the characteristic value detection section 311 selects one of the prospective values calculated at step S16 which falls within a predetermined range, thereby determining a tempo (step S17). Thus, the process is ended. The tempo, fundamental beat, and attack rate which have been calculated through the above processes are outputted to the genre information determination section 312.

Based on the characteristic values detected by the characteristic value detection section 311, the genre information determination section 312 derives intermediate data. As used herein, "intermediate data" is defined as an index, which is different from the characteristic value and which is in a form readily understandable to humans, representing the contents of input music data. Specifically, the genre information determination section 312 determines genre information based on the characteristic values obtained by the characteristic value detection section 311, i.e., the tempo, fundamental beat, and attack rate. In the present embodiment, the genre information includes a genre name and a pattern number. More specifically, the genre information determination section 312 determines a genre name from among a plurality of previosly-provided genre names. Furthermore, the genre information determination section 312 determines a patter number from among a plurality of pattern numbers which are prepared for each genre name. The determination of the genre name and the pattern number is made with reference to a characteristic value/genre name conversion table and a characteristic value/pattern conversion table which are previously provided in the genre information determination section 312. Hereinafter the characteristic value/genre name conversion table and the characteristic value/pattern conversion table will be described.

FIG. 4 shows an example of a characteristic value/genre name conversion table which is previously provided in the genre information determination section 312 shown in FIG. 2. In FIG. 4, "BPM", "FB", and "AR" mean "tempo", "fundamental beat", and "attack rate", respectively. As seen from FIG. 4, the characteristic value/genre name conversion table describes a number of criteria for each characteristic value and a corresponding number of genre names, one of which is ascertained when the associated criterion is met. In FIG. 4, "pops", "rock", "slow ballad", and "EuRo beat" are the genre names. For example, if the input characteristic values are BPM=120, FB=0.8, and AR=100, respectively, then the genre name will be determined as "rock". Although "pops", "rock", "slow ballad", and "Euro beat" are illustrated as genre names in the present embodiment, the genre names are not limited thereto.

FIG. 5 shows an example of a characteristic value/pattern number conversion table which is previously provided in the genre information determination section 312 shown in FIG. 2. As seen from FIG. 5, the characteristic value/pattern number conversion table 312 describes criteria for genre names and characteristic values, along with pattern numbers one of which is ascertained when the associated criterion is met. In the example shown in FIG. 5, tempo is used as a characteristic value for determining a pattern number. After determining a genre name, the genre information determination section 312 determines a pattern number by referring to the characteristic value/pattern number conversion table 312. For example, if the genre name is "rock " as in the above example and if BPM=120, then the pattern number is determined to be "2". The genre information thus determined, i.e., a genre name and a pattern number, is outputted to the parameter determination section 313.

Although a pattern number is determined based on the tempo in the present embodiment, a pattern number may alternatively be determined based on any characteristic value other than the tempo in other embodiments. Moreover, the pattern number may be determined on the basis of a plurality of characteristic values. Although the genre information according to the present embodiment is classified in two steps, namely, genre names and pattern numbers, the method of classification is not limited thereto. Alternatively, the genre information may be represented by either a genre name or a pattern number alone.

In accordance with the classification made by the genre information determination section 312, the parameter determination section 313 determines an acoustic processing parameter. Specifically, the parameter determination section 313 determines acoustic processing parameters based on the genre information as determined by the genre information determination section 312. As used herein, "acoustic processing parameters" are defined as parameters which determine tile tone of output data which results from the processing by the acoustic processing section 314. As mentioned above, in the present embodiment, it is assumed that the predetermined acoustic processing performed in the computation section 3 is a data compression process. In other words, the acoustic processing section 314 functions as an audio compression encoder, and the acoustic processing parameters are encode parameters which are used by tile audio compression encoder for tone adjustment. It is further assumed in the present embodiment that scale factor bands are employed as the encode parameters. Specifically, four encode parameters which respectively represent the scale factor bands are designated as "asb", "bsb", "csb", and "dsb", whose values are determined by the parameter determination section 313. The determination of these acoustic processing parameter is made with reference to a genre information/parameter conversion table which is previously provided in the parameter determination section 313. Hereinafter, the genre information/parameter conversion table will be described.

FIG. 6 shows an example of the genre information/parameter conversion table which is previously provided in a parameter determination section 313 shown in FIG. 2. As seen from FIG. 6, the genre information/parameter conversion table describes gene names and characteristic values along with their corresponding acoustic processing parameter values. In FIG. 6, "asb", "bsb", "csb", and "dsb" represent scale factor bands which are employed as the acoustic processing parameters. Any slot in the table of FIG. 6 which contains no value for "asb" to "dsb" indicates no specific value being set therefor. For example, if tile genre name is "rock" and the pattern number is "2", the acoustic processing parameters are determined as follows: asb=5; bsb=3; csb=11,13; and dsb=34,36. Note that two values are determined for each of csb and dsb in order to set two predetermined scale factor band values for each. The acoustic processing parameters which have been thus determined are outputted to the acoustic processing section 314.

In accordance with the acoustic processing parameters as determined by the parameter determination section 313, the acoustic processing section 314 performs acoustic processing, Since the acoustic processing section 314 according to the present embodiment is an audio compression encoder, the acoustic processing section 314 subjects input musical data to data compression, and outputs the compressed data as output musical data. The reproduction section 315 reproduces the output musical data from the acoustic processing section 314. Specifically, the reproduction section 315 causes the audio output section 4 to transduce the output musical data into output sounds.

Next, a second embodiment of the present invention will be described. Since the overall device structure according to the second embodiment of the present invention is similar to that of the first embodiment of the present invention as shown in FIG. 1, the following description will be set forth in conjunction with FIG. 1, thus omitting diagrammatic illustration of the overall device structure.

Figure 7:
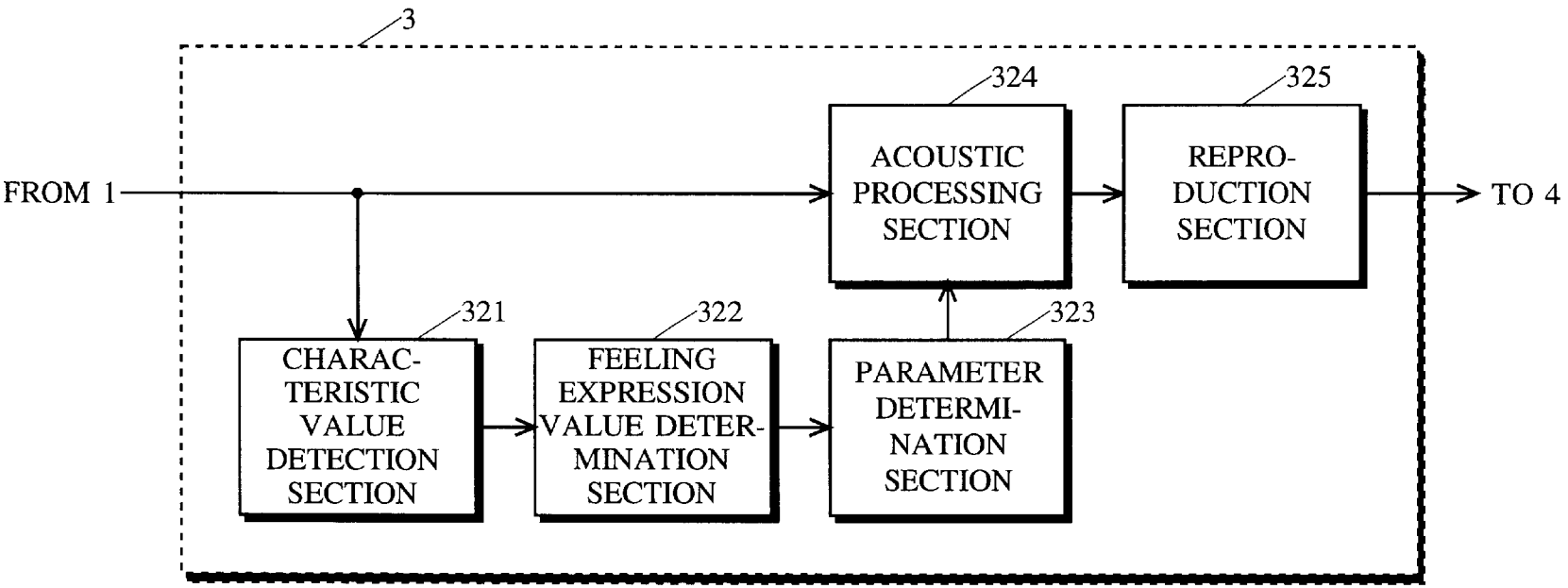
FIG. 7 is a block diagram illustrating the detailed structure of a computation section 3 of the musical signal processing device according to a second embodiment of the present invention.

FIG. 7 is a block diagram illustrating the detailed structure of a computation section 3 of the musical signal processing device according to the second embodiment of the present invention. As shown in FIG. 7, the computation section 3 includes a characteristic value detection section 321, a feeling expression value determination section 322, a parameter determination section 323, an acoustic processing section 324, and a reproduction section 325. The second embodiment of the present invention differs from the first embodiment with respect to the operation of the feeling expression value determination section 322 and the parameter determination section 323. Therefore, the operation of the computation section 3 will be described below with a particular focus on the operation of the feeling expression value determination section 322 and the parameter determination section 323. As in the first embodiment of the present invention, the present embodiment assumes that the acoustic processing section 324 functions as an audio compression encoder. It is also assumed that the acoustic processing parameters according to the present embodiment are encode parameters, similar to those used in the first embodiment of the present invention.

The characteristic value detection section 321 detects characteristic values from input musical data which has been inputted from the musical data input section 1. Based on the characteristic values detected by the characteristic value detection section 321, the feeling expression value determination section 322 derives intermediate data. Specifically, the feeling expression value determination section 322 determines a feeling expression value(s) based on tile characteristic values which have been detected by the characteristic value detection section 321. As used herein, a "feeling expression value" is defined as a numerical representation which, with respect to a feeling expression (i.e., a commonly-employed term or expression in human language that describes a certain tone), represents the psychological measure of a listener concerning a tone as described by that feeling expression. In the present embodiment, "feeling expressions" are directed to richness of the low-frequency range, dampness of the low-frequency range, clarity of vocals, and airiness of the high-frequency range. The determination of the feeling expression values is made with reference to a characteristic value/feeling expression value conversion table which is previously provided in the feeling expression value determination section 321. Hereinafter, the characteristic value/feeling expression value conversion table will be described.

FIG. 8 shows an example of a characteristic value/feeling expression value conversion table which is previously provided in the feeling expression value determination section 321 shown in FIG. 7. As seen from FIG. 8, the characteristic value/feeling expression value conversion table describes criteria for characteristic values along with sets of feeling expression values, one of which is ascertained when the associated criterion is met. In FIG. 8, "A", "B", "C", and "D" respectively represent the following feeling expressions: richness of the low-frequency range, dampness of the low-frequency range, clarity of vocals, and airiness of the high-frequency range. For example, if the input characteristic values are BPM=110, FB=0.7, and AR=95, then the feeling expression values will be determined as follows: A=1, B=2, C=3, and D=3. The feeling expression values thus determined are outputted to the parameter determination section 323.

Based on the feeling expression values as determined by the feeling expression value determination section 322, the parameter determination section 323 determines acoustic processing parameters. In the present embodiment, the determination of the acoustic processing parameters is made with reference to a feeling expression value/parameter conversion table which is previously provided in the parameter determination section 323. Hereinafter, the feeling expression value/parameter conversion table will be described.

FIG. 9 shows an example of a feeling expression value/parameter conversion table which is previously provided in a parameter determination section 323 shown in FIG. 7. As seen from FIG. 9, the feeling expression value/parameter conversion table describes feeling expression values along with their corresponding acoustic processing parameters. In FIG. 9, "A", "B", "C", and "D" represent richness of the low-frequency range, dampness of the low-frequency range, clarity of vocals, and airiness of the high-frequency range, respectively . In FIG. 9, "asb", "bsb", "csb", and "dsb" represent scale factor bands which are employed as the acoustic processing parameters, as in the case of the first embodiment of the present invention. In tile present embodiment, one feeling expression corresponds to one acoustic processing parameter. For example, if the feeling expression value "A"=1, the corresponding acoustic processing parameter is determined such that asb=4. Similarly, if the respective feeling expression values are B=2, C=3, and D=3, the corresponding acoustic processing parameters are determined as follows: bsb=3; csb=11, 14; and dsb=34, 37. The acoustic processing parameters thus determined are outputted to the acoustic processing section 324.

As described above, each acoustic processing parameter is determined based on one kind of feeling expression value in the present embodiment. In other embodiments, however, each acoustic processing parameter may be determined based on a plurality of feeling expression values.

In accordance with the acoustic processing parameter is as determined by the parameter determination section 323, the acoustic processing section 324 performs acoustic processing. Since the acoustic processing section 324 according to the present embodiment is an audio compression encoder, the acoustic processing section 324 subjects input musical data to data compression, and outputs the compressed data as output musical data. The reproduction section 325 reproduces the output musical data from the acoustic processing section 324.

Next, a third embodiment of the present invention will be described. Since the overall device structure according to the third embodiment of the present invention is similar to that of the first embodiment of the present invention as shown in FIG. 1, the following description will be set forth in conjunction with FIG. 1, thus omitting diagrammatic illustration of the overall device structure.

Figure 10:
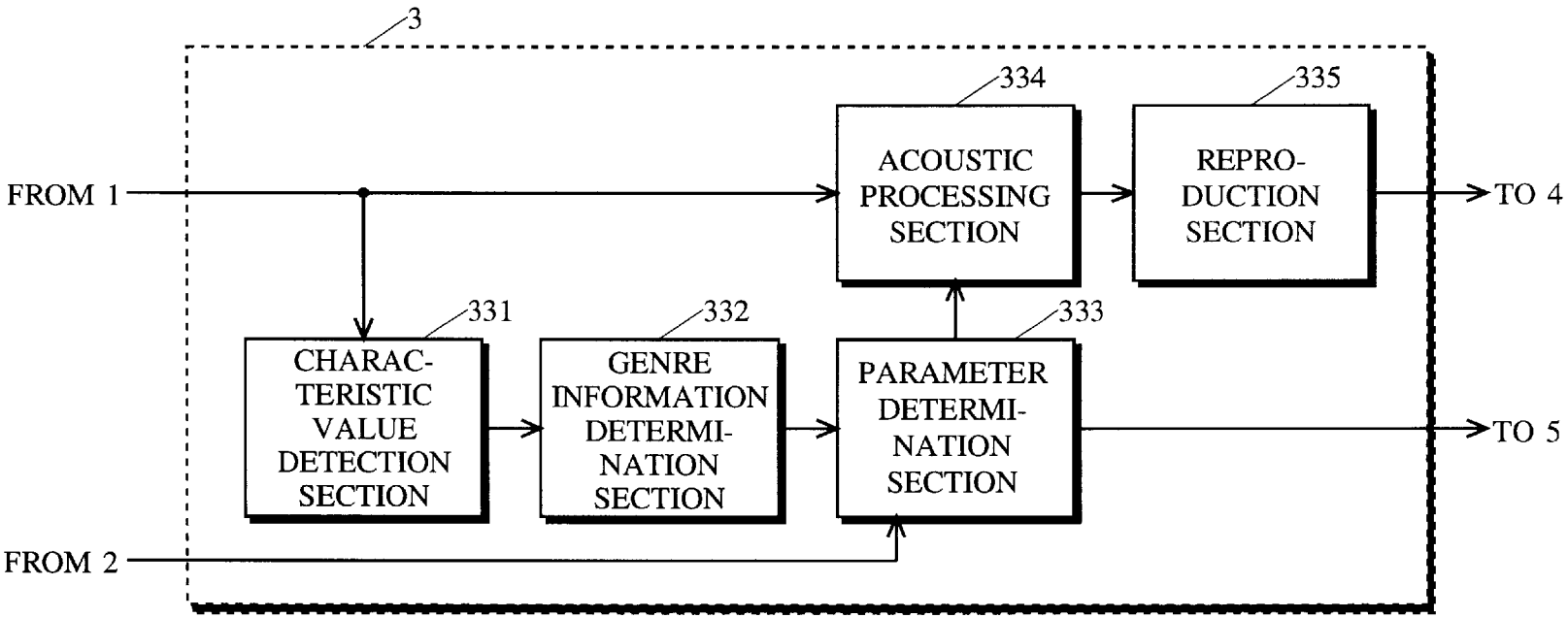
FIG. 10 is a block diagram illustrating the detailed structure of a computation section 3 of the musical signal processing device according to a third embodiment of the present invention.

FIG. 10 is a block diagram illustrating the detailed structure of a computation section 3 of the musical signal processing device according to a third embodiment of the present invention. As shown in FIG. 10, the computation section 3 includes a characteristic value detection section 331, a genie information determination section 332, a parameter determination section 333, an acoustic processing section 334, and a reproduction section 335. The third embodiment of the present invention differs from the first embodiment with respect to the operation of the genre information determination section 332 and the parameter determination section 333. Therefore, the operation of the computation section 3 will be described below with a particular focus on the operation of the genre information determination section 332 and the parameter determination section 333. As in the first embodiment of the present invention, the present embodiment assumes that the acoustic processing section 334 functions as an audio compression encoders It is also assumed that the acoustic processing parameters according to the present embodiment are encode parameters, similar to those used in the first embodiment of the present invention.

The characteristic value detection section 331 detects characteristic values from the input musical data which has been inputted from the musical data input section 1. The genre information determination section 332 determines a genre name based on the characteristic values which have been detected by the characteristic value detection section 331. In the present embodiment, the genre information determination section 332 only determines a genre name and not a pattern number. In other words, the genre information is composed only of the genre name in the present embodiment. The determination of the genre name is made with reference to a characteristic value/genre name conversion table which is previously provided in the genre information determination section 332. The characteristic value/genre name conversion table according to the present embodiment is a table similar to the characteristic value/genre name conversion table according to the first embodiment of the present invention shown in FIG. 4. The genre name thus determined is outputted to the parameter determination section 333.

In response to an input from the genre information determination section 332, the parameter determination section 333 requests a user to input a feeling expression value(s). Specifically, the parameter determination section 333 causes the display section 5 to display an image or message prompting the user to input a feeling expression(s) via the user input section 2. Based on the genre name as determined by the genre information determination section 332 and the feeling expression value(s) inputted from the user input section 2, the parameter determination section 333 determines acoustic processing parameters. The determination of acoustic processing parameters is made with reference to a genre name-feeling expression value/parameter conversion table which is previously provided in the parameter determination section 333. Hereinafter, the genre name-feeling expression value/parameter conversion table will be described.

FIG. 11 shows an example of a genre name-feeling expression value/parameter conversion table which is previously provided in a parameter determination section 333 shown in FIG. 10. As seen from FIG. 11, the genre name-feeling expression value/parameter conversion table describes genre names and feeling expression values along with their corresponding acoustic processing parameters. In FIG. 11, "asb", "bsb", "csb", and "dsb" represent scale factor bands which are employed as the acoustic processing parameters. Any slot in the table of FIG. 11 which contains no value for "asb" to "dsb" indicates no specific value being set therefore. For example, if the genre name which has been inputted from the genre information determination section 332 is "pops" and the feeling expression values which have been inputted from the user input section 2 are A=2, B=1, C=3, and D=2, then the acoustic processing parameters are determined as follows: asb=5; bsb:=2; csb=11,14; and dsb=34,36. The acoustic processing parameters which have been thus determined are outputted to the acoustic processing section 334.

In accordance with the acoustic processing parameters as determined by the parameter determination section 333, the acoustic processing section 334 performs acoustic processing. Since the acoustic processing section 334 according to the present embodiment is an audio compression encoder, the acoustic processing section 334 subjects input musical data to data compression, and Outputs the compressed data as output musical data. The reproduction section 335 reproduces the output musical data from the acoustic processing section 334.

Alternatively, a different type of feeling expressions may be used for each genre name in the present embodiment.

As described above, each acoustic processing parameter is determined based on one kind of feeling expression value in the present embodiment. In other embodiments, however, each acoustic processing parameter may be determined based on a plurality of feeling expression values.

Next, a fourth embodiment of the present invention will be described. Since the overall device structure according to the fourth embodiment of the present invention is similar to that of the first embodiment of the present invention as shown in FIG. 1, the following description will be set forth in conjunction with FIG. 1, thus omitting diagrammatic illustration of the overall device structure.

Figure 12:
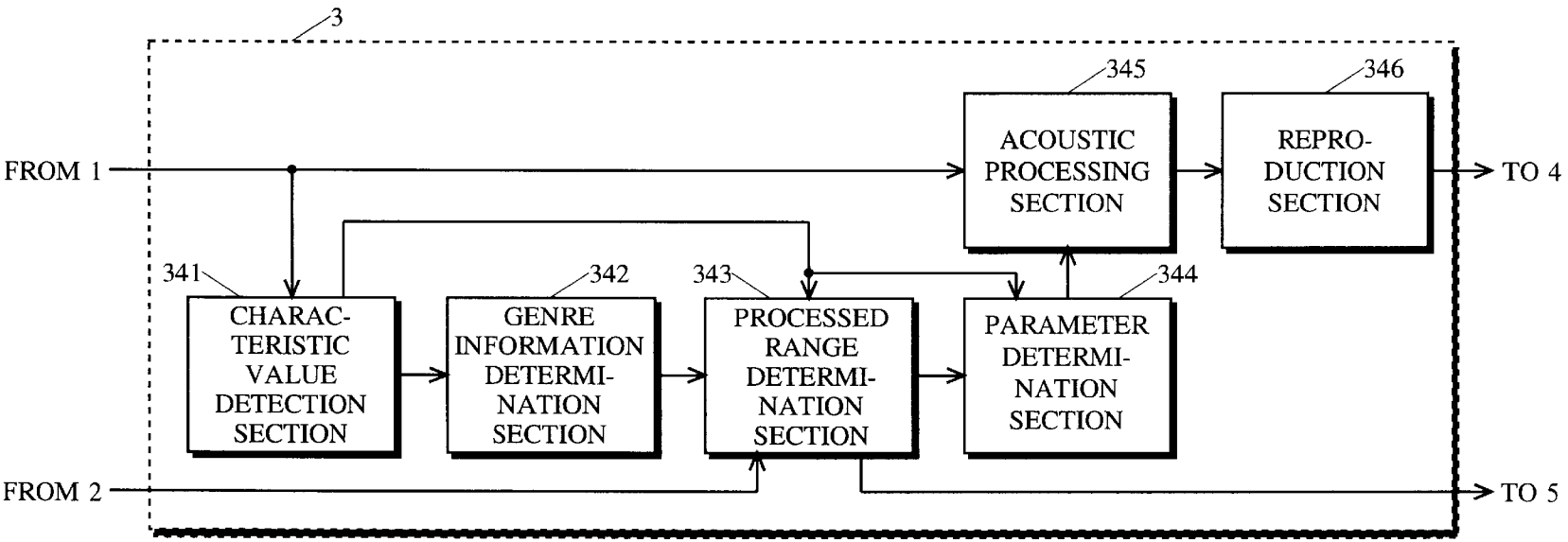
FIG. 12 is a block diagram illustrating the detailed structure of a computation section 3 of the musical signal processing device according to a fourth embodiment of the present invention.

FIG. 12 is a block diagram illustrating the detailed structure of a computation section 3 of the musical signal processing device according to a fourth embodiment of the present invention. As shown in FIG. 12, the computation section 3 includes a characteristic value detection section 341, a genre information determination section 342, a processed range determination section 343, a parameter determination section 344, an acoustic processing section 345, and a reproduction section 346. The fourth embodiment of the present invention differs from the first embodiment with respect to the operation of the characteristic value detection section 341, the processed range determination section 343, and the parameter determination section 344. Therefore, the operation of the computation section 3 will be described below with a particular focus on the operation of the characteristic value detection section 341, the processed range determination section 343, and the parameter determination section 344. As in the first embodiment of the present invention, the present embodiment assumes that the acoustic processing section 334 functions as an audio compression encoder.

The characteristic value detection section 341 detects characteristic values from the input musical data which have been inputted from the musical data input section 1. Moreover, in the present embodiment, the characteristic value detection section 341 detects a sampling frequency of the input musical data based on the input musical data which has been inputted from the musical data input section 1. The detected sampling frequency of the input musical data is outputted to the processed range determination section 343 and the parameter determination section 344.

Based on the characteristic values detected from the characteristic value detection section 341, the genre information determination section 342 determines a genre name. In the present embodiment, the genre information determination section 342 only determines a genre name and not a pattern number. In other words, the genre information is composed only of the genre name in the present embodiment. The determination of the genre name is made with reference to a characteristic value/genre name conversion table which is previously provided in the genre information determination section 342. The characteristic value/genre name conversion table according to the present embodiment is a table similar to the characteristic value/genre name conversion table according to the first embodiment of the present invention shown in FIG. 4. The genre name thus determined is outputted to the processed range determination section 343.

In response to an input from the genre information determination section 342, the processed range determination section 343 requests a user to input a feeling expression value(s). Specifically, the processed range determination section 343 causes the display section 5 to display an image or message prompting the user to input a feeling expression (s) via the user input section 2. When an input from the user input section 2 is provided, the processed range determination section 343 determines a processed range(s) based on the genre name as determined by the genre information determination section 342, the sampling frequency of the input musical data as detected by the characteristic value detection section 341, and the feeling expression value(s) inputted from the user input section 2. As used herein, a "processed range" means a frequency range to be subjected to predetermined acoustic processing. A "processed range" is expressed in terms of the central frequency of the processed range. The determination of the processed range(s) is made with reference to a feeling expression value/processed range conversion table which is previously provided in the processed range determination section 343. Hereinafter, the feeling expression value/processed range conversion table will be described.

FIG. 13 shows an example of a feeling expression value/processed range conversion table which is previously provided in the processed range determination section 343 shown in FIG. 12. As seen from FIG. 13, the feeling expression value/processed range conversion table describes genre names, feeling expression values, and sampling frequencies, along with their corresponding processed ranges. In FIG. 13, "A", "B", "C", and "D" are feeling expressions. As in the second embodiment of the present invention, "A" to "D" represent richness of the low-frequency range, dampness of the low-frequency range, clarity of vocals, and airiness of the high-frequency range, respectively, in the present embodiment. In FIG. 13, "Fs" represents a sampling frequency of input musical data. For example, if the genre name is "rock"; Fs=44.1(kHz); A=2, B=1, C=2, and D=3, then the respective processed ranges are determined to be 0.055, 0.08, 1.0, 1.2, 11, and 13(kHz) (note that these values represent the central frequencies of the respective processed ranges). The processed ranges thus determined are outputted to the parameter determination section 344.

Based on the sampling frequency of the input musical data as detected by the characteristic value detection section 341 and the frequency ranges as determined by the processed range determination section 343, the parameter determination section 344 determines acoustic processing parameters. Since the acoustic processing section 345 according to the present embodiment is an audio compression encoder as in the case of the first embodiment of the present invention, the acoustic processing parameter employed in the present embodiment is an encode parameter. Note, however, that the encode parameter employed in the present embodiment is different from "asb" to "dsb" as employed in the first to third embodiments of the present invention. In order to distinguish over "asb" to "dsb", the encode parameter employed in the present embodiment is denoted as "esb" The determination of the acoustic processing parameter is made with reference to a processed range/parameter conversion table which is previously provided in the parameter determination section 344. Hereinafter, the processed range/parameter conversion table will be described.

FIG. 14 is a table describing the correspondence between scale factor band values and input data frequencies, which varies depending on tile sampling frequency of the input data. In FIG. 14, "Fs" represents the sampling frequency of the input data, and "SFB" represents a scale factor band. As shown in FIG. 14, the correspondence between scale factor band values and input data frequencies varies depending on the sampling frequency of the input data. A processed range/parameter conversion table employed in the parameter determination section 344 is prepared based on the correspondence shown in FIG. 14.

FIG. 15 shows an example of a processed range/parameter conversion table which is previously provided in the parameter determination section 344 shown in FIG. 12. As seen from FIG. 15, tile processed range/parameter conversion table describes sampling frequencies of the input musical data and the processed ranges as determined by the processed range determination section 343, along with their corresponding scale factor band values (acoustic processing parameter: "esb"). In FIG. 15, each value which is indicated in the column dedicated to processed ranges represents the central frequency of the corresponding processed range. "Fs" represents the sampling frequency of the input musical data.

In FIG. 15, one of the processed ranges (central frequencies) is selected in the following manner. Basically, the processed range (central frequency) which is the closest to the processed range (central frequency) inputted from the processed range determination section 343 is selected. If the processed range (central frequency) inputted from the processed range determination section 343 falls exactly halfway between two processed ranges (central frequencies), then the lower processed range(central frequency) is selected. For example, if the sampling frequency of the input musical data is 44.1(kHz) and the central frequency of the processed range is "225 Hz", then the acoustic processing parameter is determined such that esb=2. When a plurality of processed ranges (central frequencies) are inputted from the processed range determination section 343, a plurality of scale factor band values are determined. The acoustic processing parameter (s) thus determined is outputted to the acoustic processing section 345.

The acoustic processing section 345 performs acoustic processing in accordance with the acoustic processing parameter as determined by the parameter determination section 344. Since the acoustic processing section 345 according to the present embodiment is an audio compression encoder, the acoustic processing section 345 subjects input musical data to data compression, and outputs the compressed data as output musical data. The reproduction section 346 reproduces the output musical data from the acoustic processing section 345.

Although the first to fourth embodiments of the present invention are directed to the case where the acoustic processing section is an audio compression encoder, the acoustic processing section is not limited to such. For example, the acoustic processing section may function as a tone connection means, e.g., a graphic equalizer, a compressor, a tone control, a gain control, a reverb machine, a delay machine, a flanger machine, or a noise reduction device, all audio data editing means, e.g., a cross-fading device; or an audio embedding means, e.g., an electronic watermark data embedder.

Although the first to fourth embodiments are directed to the case where the acoustic processing parameters are scale factor bands for tone adjustment used in conjunction with an audio compression encoder, the acoustic processing parameters are not limited to such. For example, threshold values for long/short determination for a block switch, assigning methods for use in a quantization means, bit reservoirs, determination criteria for tone components, threshold values for determining correlation between right and left channels, and the like may be employed as acoustic processing parameters for the audio compression encoders In the case where the acoustic processing section is not an audio compression encoder, for example, filter types (low-pass filters, high-pass filters, band-pass filters, etc.), constants used in a graphic equalizer (Q, central frequency, dB), gains, quantization bit numbers, sampling frequency, chancel numbers, filter ranges, reverb times, delay times, power ratios between direct/indirect sounds, or degrees (depth, frequency, etc.) of watermark embedding, and the like may be employed as acoustic processing parameters for the acoustic processing section.

Next, a fifth embodiment of the present invention will be described. Since the overall device structure according to the fifth embodiment of the present invention is similar to that of the first embodiment of the present invention as shown in FIG. 1, the following description will be set forth in conjunction with FIG. 1, thus omitting diagrammatic illustration of the overall device structure.

Figure 16:
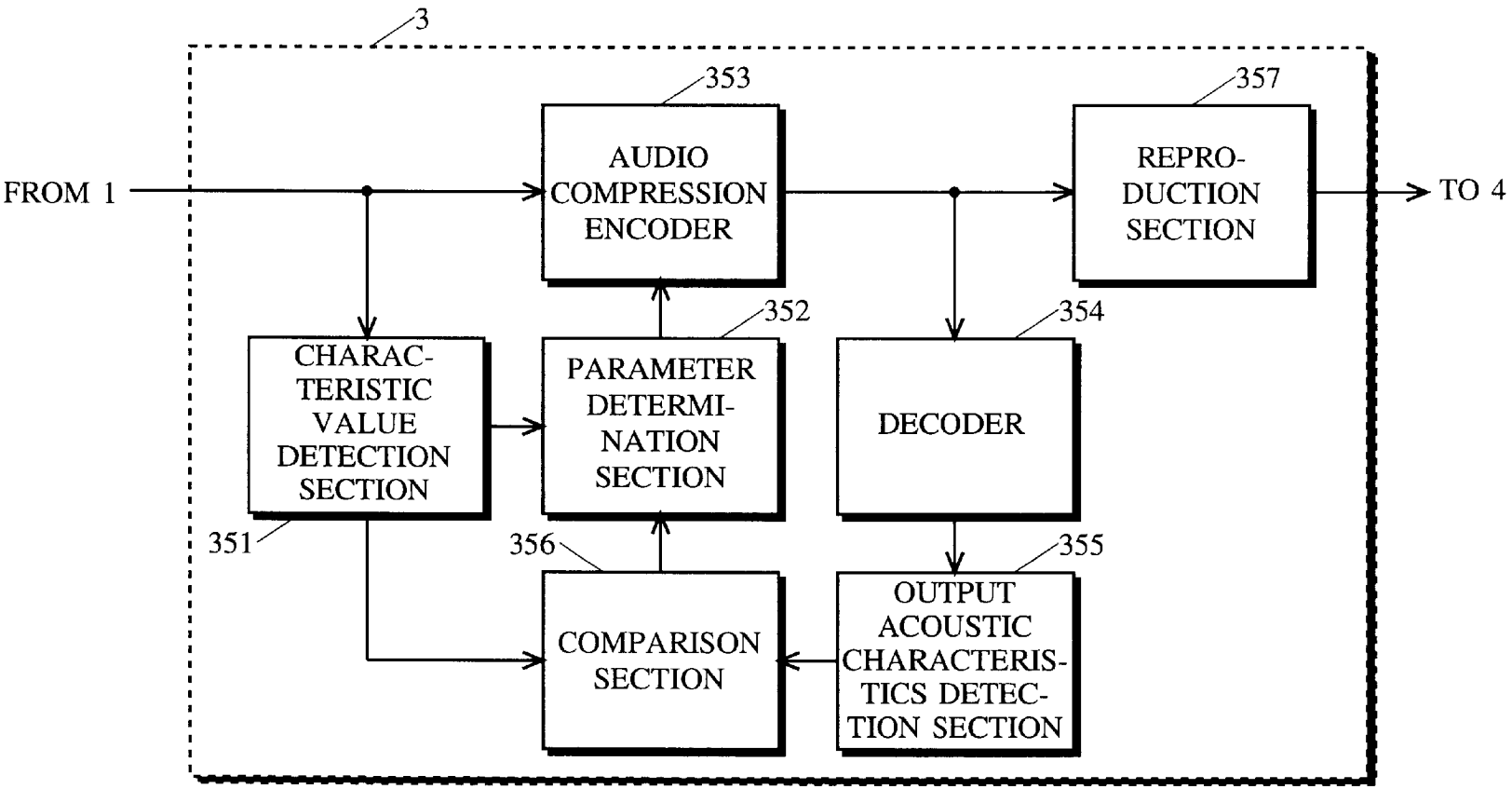
FIG. 16 is a block diagram illustrating the detailed structure of a computation section 3 of the musical signal processing device according to a fifth embodiment of the present invention.

FIG. 16 is a block diagram illustrating the detailed structure of a computation section 3 of the musical signal processing device according to a fifth embodiment of the present invention. As shown in FIG. 16, the computation section 3 includes a characteristic value detection section 351, a parameter determination section 352, an audio compression encoder 353, a decoder 354, an output acoustic characteristics detection section 355, a comparison section 356, and a reproduction section 357. Hereinafter, the respectively elements will be specifically described, and tile operation of the computation section 3 will be described.

The characteristic value detection section 351 detects a characteristic value from the input musical data which has been inputted from the musical data input section 1. The characteristic value according to the present embodiment is a sampling frequency of the input musical data. The characteristic value which has been detected by the characteristic value detection section 351 is outputted to the parameter determination section 352. The characteristic value detection section 351 also detects an instantaneous average power value for each frequency range through DFT, which is outputted to the comparison section 356.

When the input musical data is initially inputted to the computation section 3, the characteristic value detection section 351 outputs a characteristic value to the parameter determination section 352, which determines a predetermined fixed value as an acoustic processing parameter. The acoustic processing parameter in the present embodiment is identical to the scale factor band (esb) according to the fourth embodiment of the present invention. After the initial determination of the acoustic processing parameter by the parameter determination section 352 is made, if an input is received from the comparison section 356, then the parameter determination section 352 modifies the acoustic processing parameter based on the input from the characteristic value detection section 351 and the input from the comparison section 356. The modification of the acoustic processing parameter is made with reference to a processed range/parameter conversion table which is previously provided in the parameter determination section 352. The processed range/parameter conversion table employed in the fifth embodiment of the present invention is similar to the processed range/parameter conversion table shown in FIG. 15. The acoustic processing parameter which has been thus determined or modified is outputted to the audio compression encoder 353.

Each time an acoustic processing parameter is outputted from the parameter determination section 352, the audio compression encoder 353 performs a data compression process in accordance with tile outputted acoustic processing parameter. The output musical data which has been compressed by the audio compression encoder 353 is outputted to the reproduction section 357 and the decoder 354.

Each time the audio compression encoder 353 outputs musical data, the decoder 354 decodes the output musical data from the audio compression encoder 353. Each time the decoder 354 decodes the output musical data, the output acoustic characteristics detection section 355 detects the acoustic characteristics of the output musical data based on the output from the decoder 354. Specifically, the output acoustic characteristics detection section 355 detects an instantaneous average power value for each frequency range through a DFT, and outputs the detected instantaneous average power value to the comparison section 356.

Figure 17:
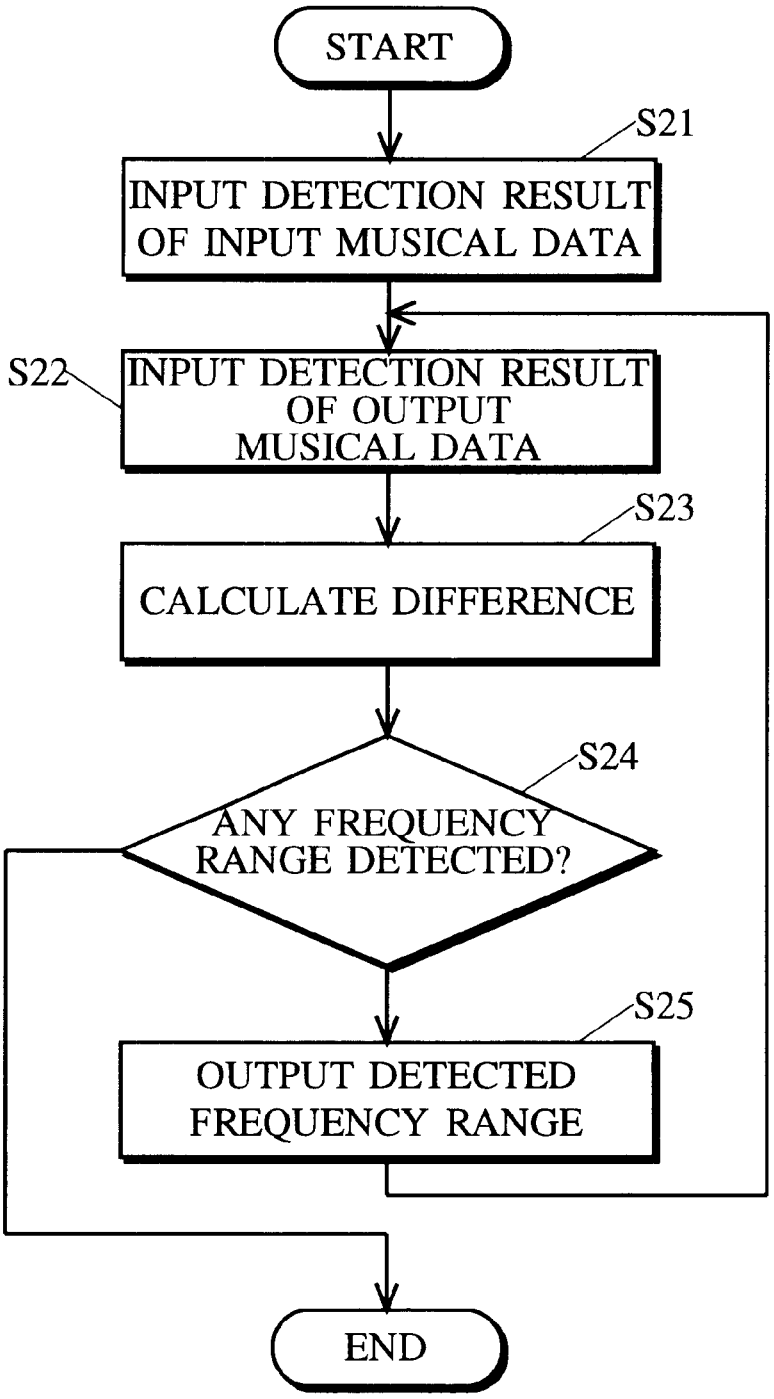
FIG. 17 is a flowchart illustrating a flow of process performed by a comparison section 356 shown in FIG. 16.

The comparison section 356 compares the instantaneous average power values which are inputted from the characteristic value detection section 351 and the output acoustic characteristics detection section 355. FIG. 17 is a flowchart illustrating a flow of process performed by the comparison section 356 shown in FIG. 16. Hereinafter, the operation of the comparison section 356 will be described with reference to FIG. 17. 100741 First, the comparison section 356 receives an instantaneous average power value of the input musical data from the characteristic value detection section 351 (step S21). Next, the comparison section 356 receives an instantaneous average power value of the decoded output musical data from the output acoustic characteristics detection section 355 (step S22). Next, the comparison section 356 calculates a difference between the instantaneous average power values of the input musical data and output musical data with respect to each frequency range (step S23). Based on the results of the calculation, the comparison section 356 determines whether or not any frequency range is detected for which the aforementioned difference is equal to or greater than a predetermined level (e.g., 1 dB) (step S24). The predetermined level is internalized in the comparison section 356.

If no frequency range is detected at step S24 for which the aforementioned difference is equal to or greater than the predetermined level, the comparison section 356 ends its processing. If a frequency range is detected at step S24 for which the aforementioned difference is equal to or greater than the predetermined level, then the comparison section 356 outputs the detected frequency range to the parameter determination section 353 (step S25). After step S25, the comparison section 356 returns to the process of step S22, and awaits an input from the output acoustic characteristics detection section 355. The comparison section 356 repeats the processes from step S22 to step S25 until no more frequency range is detected at step S24 for which the aforementioned difference is equal to or greater than the predetermined level. The frequency range(s) which has been thus detected by the comparison section 356 is outputted to the parameter determination section 353.

The reproduction section 357 begins reproducing musical data when the reproduction section 357 first receives the output musical data from the audio compression encoder 353. When the reproduction section 357 receives the output musical data from the audio compression encoder 353 for the second time or later, the reproduction section 357 updates the musical data which is being reproduced.

Thus, according to the fifth embodiment of the present invention, a frequency range(s) in which the Output musical data has a substantial difference from the input musical data is detected, and the acoustic processing parameter is modified in light of such detected frequency ranges. By thus modifying the acoustic processing parameter, any tone degradation associated with the use of the audio compression encoder can be alleviated.

In the first to fifth embodiments of the present invention described above, genre names, pattern numbers, feeling expression values, acoustic processing parameters, and processed ranges are derived by using various tables. In other embodiments, calculation formula may be employed instead of conversion tables.

In other embodiments, the respective conversion tables may be arranged so that their contents is freely alterable via the user input section 2. As a result, even if the reproduced music does not reflect a particular tone desired by a user, the user can change the contents of the conversion tables so that the desired tone is obtained. Especially in the case where feeling expression values are employed as described in the second embodiment of the present invention, the user can easily set the conversion table so that the desired tone can be obtained with preciseness.

The first to the fifth embodiments of the present invention may be modified so that pre-processing is performed before musical data is input to the acoustic processing section or the audio compression encoder. Such pre-processing would be performed for the musical data to be inputted to the acoustic processing section or the audio compression encoder. For example, it may be desirable to perform pre-processing by allocating more bits for ranges having higher energy levels, in order to prevent deterioration in the sound quality of any musically-essenitial portions during the audio compression by an audio compression encoder. Specific methods of pre-processing may involve reducing the energy level, removing phase components, and/or compressing the dynamic range in any frequency components which are above or below a certain frequency. For example, if the input musical data is a piece of instrumental music which has a high concentration in the lower frequency range, e.g., music played with a contrabass marimba, the input musical data may be subjected to pre-processing using a low-pass filter.

Figure 18:
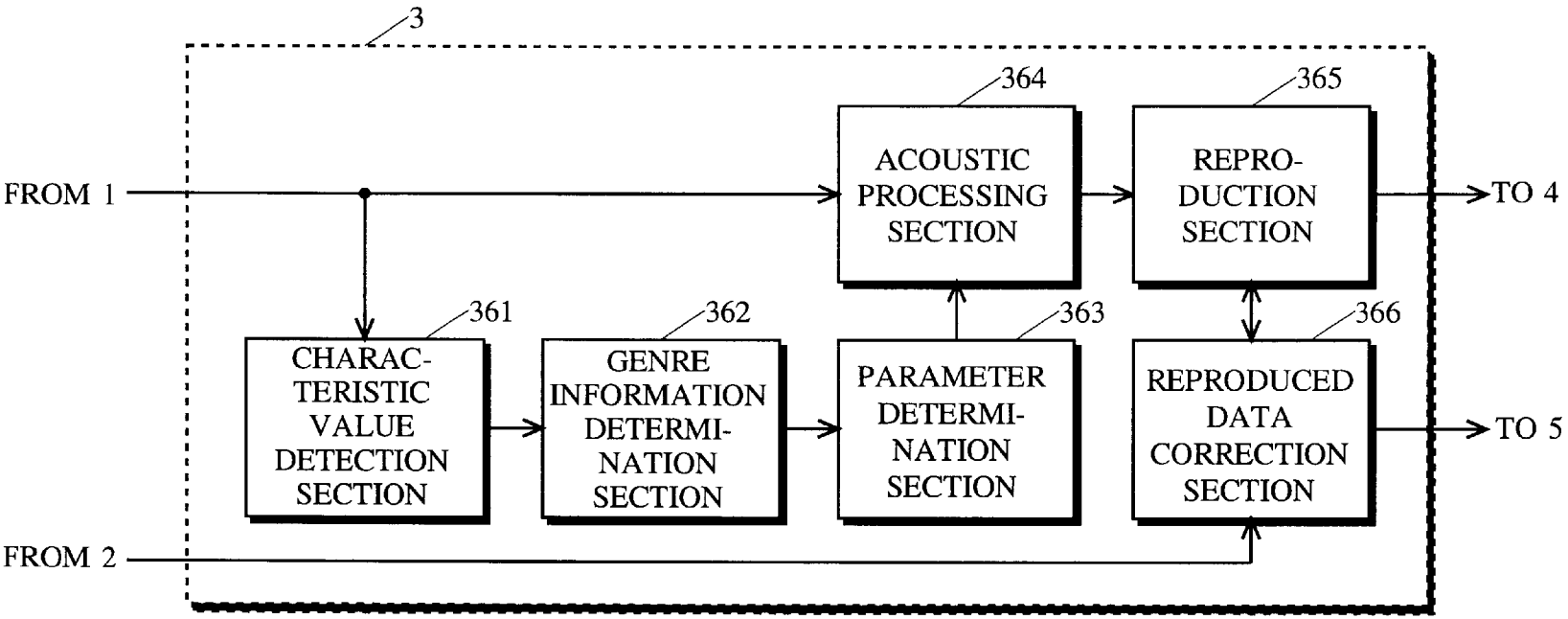
FIG. 18 is a block diagram illustrating a variant of the computation section 3 according to the first embodiment of the present invention.

In the first to fifth embodiments of the present invention described above, the musical signal processing device may be arranged so as to allow a user to adjust the resultant tone. FIG. 18 is a block diagram illustrating a variant of the computation section 3 according to the first embodiment of the present invention. As shown in FIG. 18, the computation section 3 includes a characteristic value detection section 361, a genie information determination section 362, a parameter determination section 363, an acoustic processing section 364, a reproduction section 365, and a reproduced data connection section 366. The structure shown in FIG. 18 differs from the structure shown in FIG. 2 only with respect to the reproduced data correction section 366. The below description will focus on this difference.

Figure 19:
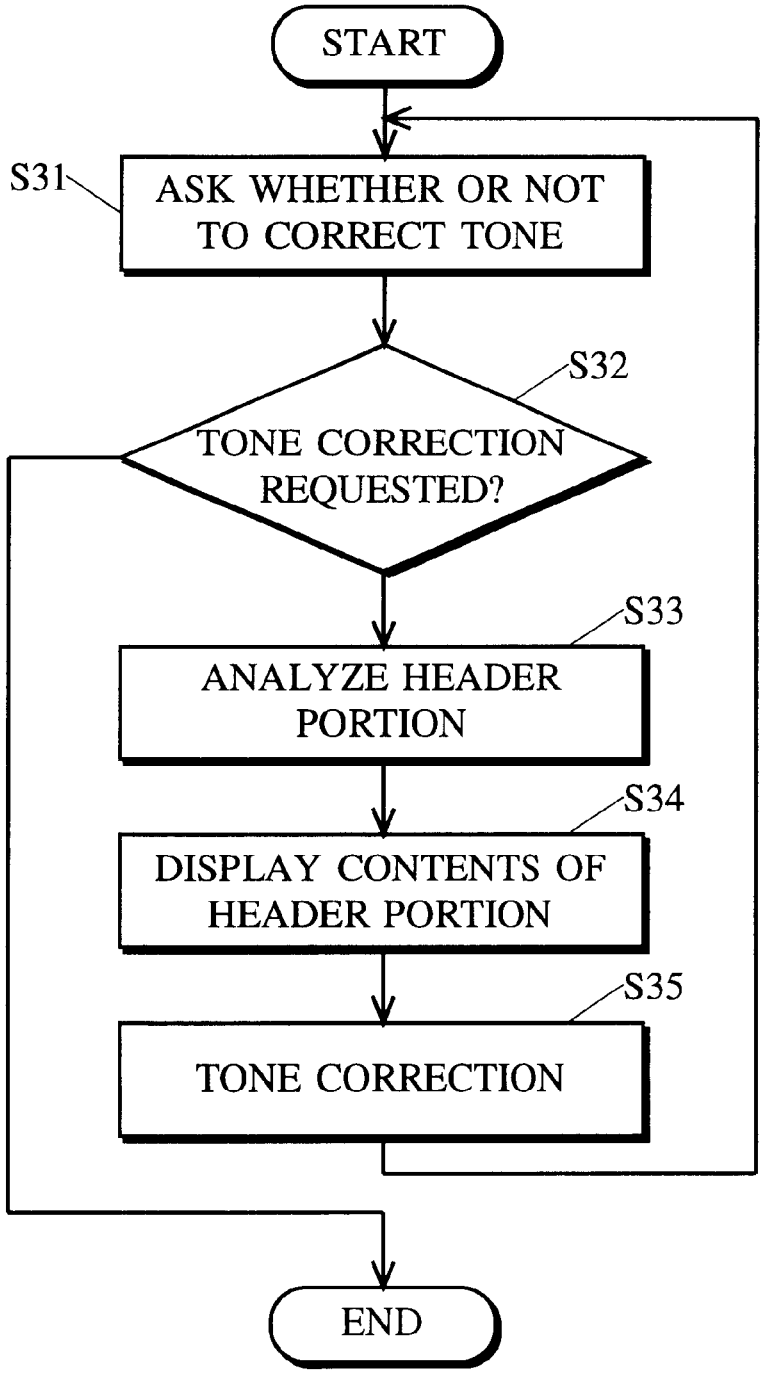
FIG. 19 is a flowchart illustrating a flow of process performed by a reproduced data correction section 366 shown in FIG. 18.
Figure 20:
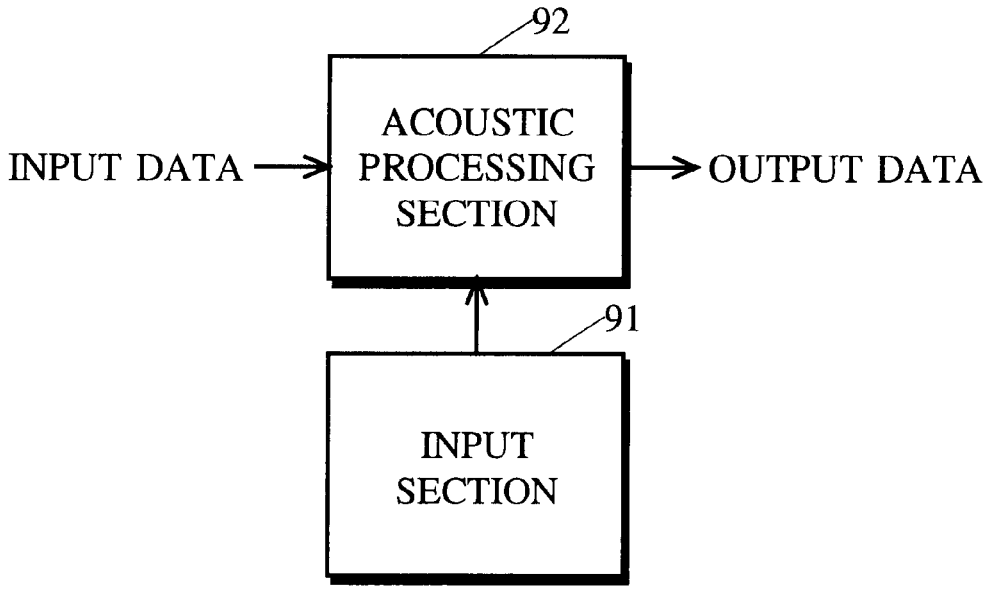
FIG. 20 PRIOR ART
FIG. 20 is a block diagram illustrating the structure of a conventional musical signal processing device which is in common use.

FIG. 19 is a flowchart illustrating a flow of process performed by the reproduced data connection section 366 shown in FIG. 18. The process shown in FIG. 19 begins as the data reproduction by the reproduction section is started. First, the reproduced data connection section 366 asks the user as to whether or, not the user wishes to collect the tone (step S31). The process of step S31 is accomplished by causing the display section 5 to display this question. In response to the question displayed by the display section 5, the user indicates whether or not to correct the tone, this input being made via the user input section 2. Next, the reproduced data correction section 366 determines whether or not a tone correction is being requested, based on the input from the user input section 2 (step S32). If it is determined at step S3 that a tone correction is not being requested, then the reproduced data collection section 366 ends its process.

On the other hand, if it is determined at step S32 that a tone collection is being requested, then the reproduced data collection section 366 reads the data which is under reproduction by the reproduction section, and reads the contents of the header portion of the data (step S33). Note that the header portion of the data which is outputted from the acoustic processing section to be reproduced by the reproduction section contains data representing the acoustic characteristics (e.g., the tempo, beat, rhythm, frequency pattern, and genre information) of a piece of music to be reproduced. Next, the reproduced data correction section 366 causes the display section 5 to display the contents of the header portion which has been read at step S3, i.e., data representing the acoustic characteristics of the piece of music to be reproduced (step S34). Then, by using the user input section 2, the user may input instructions as to how to collect the tone based on the actual sound which is being reproduced by the reproduction section and the contents being displayed by the display section 5. For example, if the user feels that it is necessary to boost the low-frequency range based on the sound which is being reproduced and the contents being displayed by the display section 5, the user may input an instruction to accordingly change the level in a predetermined frequency range.

Then, the reproduced data collection section 366 connects the tone of the data which is being reproduced by the reproduction section in accordance with the user input from the user output section 2 (step S35). After the process of step S35, the reproduced data collection section 366 returns to the process of step S31, and repeats the processes from steps S31 to S35 until it is determined at step S32 that further tone correction is not requested.

It will be appreciated that not only the first embodiment of the present invention but also the second to fifth embodiments of the present invention permit variants in which a user is allowed to adjust the resultant tone. This can be realized by providing the reproduced data correction section shown in FIG. 18 and performing processes similar to those described in FIG. 19.

While the invention has been described in detail, the foregoing description is in all aspects illustrative and not restrictive. It is understood that numerous other modifications and variations can be devised without departing from the scope of the invention.

What is claimed:

1. A musical signal processing device for applying predetermined acoustic processing to input musical data, said musical signal processing device comprising:

a characteristic value detection section for analyzing acoustic characteristics of the input musical data, and as a result of the analysis, detecting a characteristic value representing characteristics of contents of the input musical data;

a genre information determination section for, based on the characteristic value detected by said characteristic value detection section, determining genre information representing a genre in which the input musical data is classified;

a user input section for receiving a feeling expression value which is inputted by a user, the feeling expression value representing a psychological measure of the user concerning a tone of music;

a parameter determination section for determining an acoustic processing parameter in accordance with the feeling expression value received by said user input section and the genre information determined by said genre information determination section, the acoustic processing parameter being used for adjusting a tone of an output of the predetermined acoustic processing; and an acoustic processing section for applying the predetermined acoustic processing to the input musical data in accordance with the acoustic processing parameter determined by said parameter determination section.

2. The musical signal processing device according to claim 1, wherein the feeling expression value received by said user input section is of a different type depending on the genre represented by the genre information determined by said genre information determination section.

3. The musical signal processing device according to claim 1, wherein:

said acoustic processing section is an audio compression encoder for applying data compression to the input musical data; and said musical signal processing device further comprises:

a decoder for decoding an output from said audio compression encoder to generate decoded data; and a comparison section for comparing acoustic characteristics of the input musical data and acoustic characteristics of the decoded data from said decoder to detect a frequency range in which the acoustic processing parameter is to be modified, wherein said parameter determination section modifies the acoustic processing parameter with respect to the frequency range detected by said comparison section.

4. A musical signal processing method for applying predetermined acoustic processing to input musical data, said musical signal processing method comprising:

analyzing acoustic characteristics of the input musical data, and as a result of said analyzing of the acoustic characteristics, detecting a characteristic value representing characteristics of contents of the input musical data;

based on the characteristic value detected by said detecting of the characteristic value, determining genre information representing a genre in which the input musical data is classified;

receiving a feeling expression value from a user, the feeling expression value representing a psychological measure of the user concerning a tone of music;

determining an acoustic processing parameter in accordance with the feeling expression value received by said receiving of the expression value and the genre information determined by said determining of the genre information, the acoustic processing parameter being used for adjusting a tone of an output of the predetermined acoustic processing; and applying the predetermined acoustic processing to the input musical data in accordance with the acoustic processing parameter determined by said determining of the acoustic processing parameter.

5. The musical signal processing method according to claims 4, wherein the feeling expression value is of a different type depending on the genre represented by the genre information determined by said determining of the genre information.

6. The musical signal processing method according to claim 4, wherein:

said applying of the predetermined acoustic processing comprises applying data compression to the input musical data to produce compressed data; and said musical signal processing method further comprises:

decoding the compressed data to generate decoded data; and comparing acoustic characteristics of the input musical data and acoustic characteristics of the decoded data to detect a frequency range in which the acoustic processing parameter is to be modified, wherein said determining of the acoustic processing parameter comprises modifying the acoustic processing parameter with respect to the frequency range detected by said comparing of the acoustic characteristics of the input musical data and the acoustic characteristics of the decoded data.

* * * * *

UNITED STATES PATENT AND TRADEMARK OFFICE

CERTIFICATE OF CORRECTION

PATENT NO. : 6,673,995 B2
DATED : January 6, 2004
INVENTOR(S) : Michiko Ogawa et al.

It is certified that error appears in the above-identified patent and that said Letters Patent is hereby corrected as shown below:

Column 22,
Line 28, replace “claims” with -- claim --.

Signed and Sealed this

Thirteenth Day of April, 2004

JON W. DUDAS
*Acting Director of the United States Patent and Trademark Office*